United States Patent [19]

Lemonnier et al.

[11] 4,045,521

[45] Aug. 30, 1977

[54] CARBURETTOR ENRICHING DEVICE

[75] Inventors: Jean-Yves Lemonnier; Lucien Chatelain, both of Boulogne-Billancourt, France

[73] Assignees: Regie Nationale des Usines Renault; Automobiles Peugeot, both of Paris, France

[21] Appl. No.: 722,356

[22] Filed: Sept. 13, 1976

[30] Foreign Application Priority Data

Sept. 15, 1975 France ..... 75/28263

[51] Int. Cl.[2] ..... F02M 7/04

[52] U.S. Cl. ..... 261/41 R; 261/121 A

[58] Field of Search ..... 261/41 R, 39 D, 121 A

[56] References Cited

U.S. PATENT DOCUMENTS

| | | | |
|---|---|---|---|
| 1,929,266 | 10/1933 | Viel | 261/121 A |
| 2,103,689 | 12/1937 | Mullen, Jr. | 261/41 R |
| 2,208,317 | 7/1940 | Beck | 261/41 R |
| 2,852,240 | 9/1958 | Goodyear | 261/41 R |
| 2,981,245 | 4/1961 | Sarto | 261/39 D |
| 3,664,648 | 5/1972 | Seeley, Jr. | 261/41 R |

FOREIGN PATENT DOCUMENTS

| | | | |
|---|---|---|---|
| 472,865 | 4/1914 | France | 261/41 R |
| 549,563 | 11/1922 | France | 261/121 A |

*Primary Examiner*—Tim R. Miles

*Attorney, Agent, or Firm*—Fleit & Jacobson

[57] ABSTRACT

Enriching device for carburettors of internal combustion engines, which comprises an aeration gaged orifice located at the upper portion of the float tank of the carburettor, a fuel gaged orifice communicating with the bottom of said fuel tank, an air/fuel mixture gaged orifice disposed in a passage interconnecting said aeration gaged orifice and said fuel gaged orifice, and delivering said mixture at the level of the carburettor venturi, and an additional gaged orifice opening into the main passage of the carburettor, wherein said additional gaged orifice is located at the end of a pipe section projecting to a predetermined extent into the main passage upstream of said venturi and slightly upstream of the closed position of the starter shutter, whereby said additional gaged orifice, according to the negative pressure discrepancy existing between its position and that of the mixture gaged orifice will regulate the richness of the air/fuel mixture by performing successively as an additional air inlet orifice for producing a leaner mixture passing through the mixture gaged orifice under low or moderate engine load conditions, this function decreasing gradually to zero, during the range of part-load operating conditions, and then as a gaged orifice supplying an additional output of air/fuel mixture, therefore as an enriching device, under high-load engine conditions.

2 Claims, 1 Drawing Figure

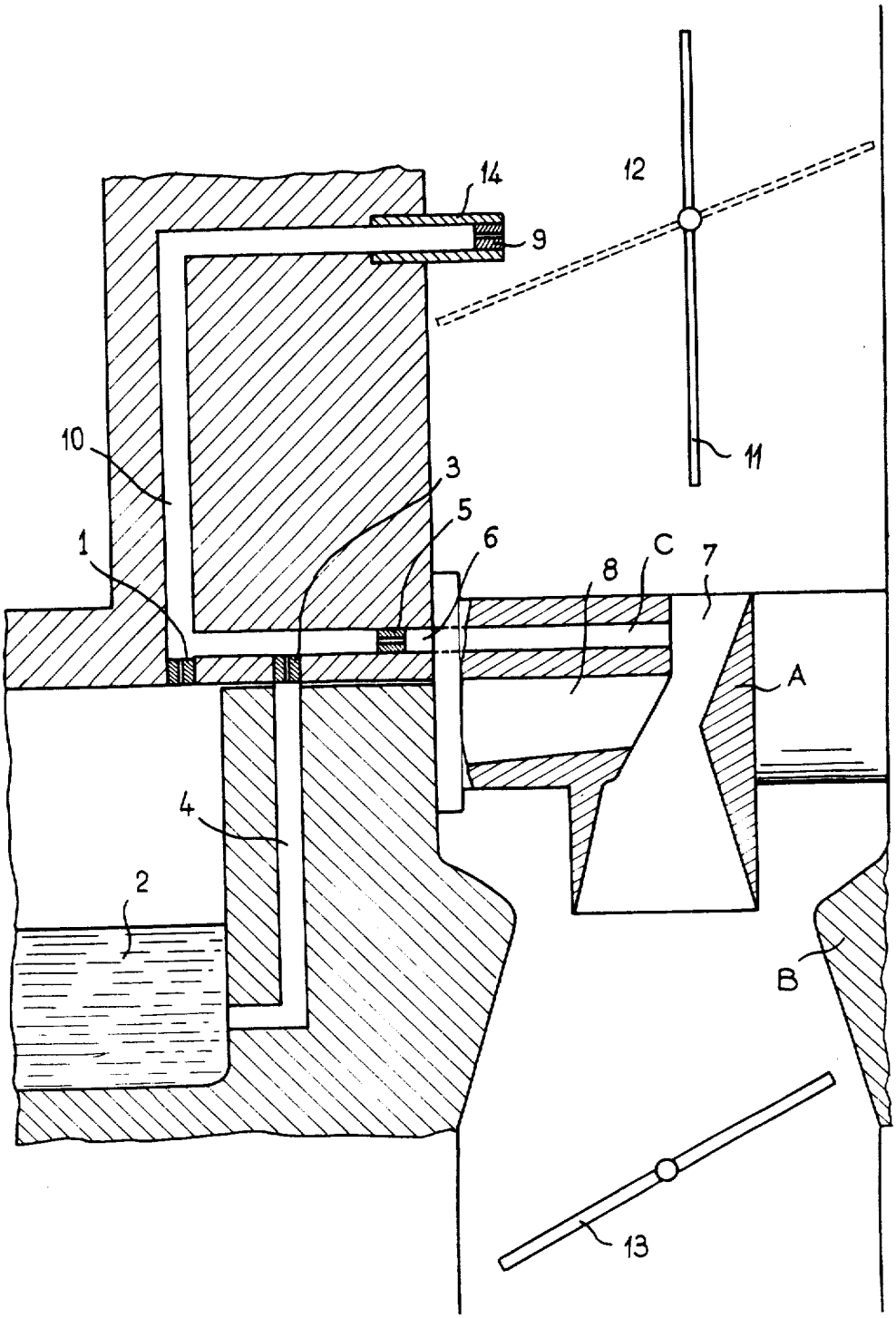
14
12
9
10
3
5
6
1
8
C
7
A
4
2
B
13
11

CARBURETTOR ENRICHING DEVICE

This invention relates in general to carburettors for internal combustion engines and has specific reference to a mixture-enriching device intended more particularly for carburettors equipped with anti-pollution means.

In fact, it is observed that even on internal combustion engines provided with anti-pollution devices an inaccurate richness adaptation is frequently the case of an increment in the formation of polluting substances and also of a waste of fuel during transient periods or phases of the engine operation.

Enriching devices are known wherein the optimum richness during both transient phases and part-load periods is obtained by using systems of which the output cannot be varied through a wide range of operating conditions, such as fixed output orifices, whereby these devices cannot ensure a perfect adaptation or regulation of the desired richness.

The mixture enriching device for carburettors and more particularly twin-choke or diffuser carburettors, as contemplated in the present invention, affords through a better regulation of the fuel output a substantial improvement towards an optimized adaptation of the mixture richness in relation to the engine load, whereby the fuel consumption can be reduced appreciably while minimizing the formation of polluting substances during the transient phases and under part-load operation.

This carburettor enriching device comprises a gaged air orifice disposed at the upper portion of the float tank, a gaged fuel orifice communicating with the bottom of said float tank and an air-fuel mixture gaged orifice opening at the level of the carburettor venturi.

This device is characterised essentially in that it comprises an additional gaged orifice or jet opening into the main air flow passage of the carburettor, upstream of the venturi and slightly upstream of the closed position of the starter shutter, this gaged orifice being disposed at the end of a pipe section projecting to a predetermined extent into the air flow passage, so that, according to the pressure discrepancy prevailing between its position and that of the air/fuel mixture gaged orifice, said additional gaged orifice or jet will regulate the richness by acting successively as an additional air inlet orifice for producing a leaner mixture passing through the air/fuel mixture gaged orifice under low or moderate engine load conditions, this function decreasing gradually to zero, during the range of part-load operating conditions, and then as a gaged orifice supplying an additional output of air/fuel mixture, therefore as an enriching device under high-load engine conditions.

The principle advantages provided by this device are the low carbon monoxide content obtained without increasing the emissions of nitrogen oxide, and its great simplicity since the richness regulation is governed only by the law of fluid mechanics.

Other features and advantages of this invention will appear as the following description proceeds with reference to the attached drawing of which the single FIGURE illustrates diagrammatically by way of example a preferred form of embodiment of this enriching device for internal combustion engine carburettors, wherein the device associated with a downdraught vertical carburettor comprising two axially spaced diffusers or venturis is shown in part-sectional view.

The carburettor illustrated diagrammatically in axial section comprises twin diffusers A and B disposed coaxially but axially spaced in the main air flow passage 12, the main jet C opening into the venturi 7 slightly upstream of the neck of the central diffuser A.

The enriching device comprises an aeration jet or gaged orifice 1 located at the upper portion of the float chamber 2, a fuel jet or gaged orifice 3 communicating with the bottom of the float chamber 2 via a passage 4, and an air/fuel mixture gaged orifice or jet 5 interposed in another passage 6, the air jet 1 and fuel jet 3 opening into this passage 6 leading in turn into the venturi 7 of the carburettor slightly upstream of the air/fuel mixture outlet 8 of the main circuit. This device further comprises according to this invention an additional gaged orifice or jet 9 communicating via a passage 10 with the passage 6 overlying coaxially the aeration jet 1 and opening into the main air flow 12 of the carburettor upstream of the venturi 7, substantially at the level of the starter shutter or butterfly strangler 11.

This additional jet 9, as illustrated in the FIGURE, is disposed at the end of a pipe section 14 force fitted into the side wall of the main passage 12 of the carburettor at the inlet of a passage 10, so as to project to a predetermined extent into this air flow 12, slightly upstream of the closed position of said starter shutter 11, whereby this additional jet 9 responsive to the atmospheric pressure when the shutter 11 is closed is responsive indirectly via the main air flow passage 12 to the pressure regulation resulting from the movements of the main throttle butterfly valve 13 when said starter shutter 11 is open.

The above-described device operates according to the laws of fluid mechanics, as follows:

Under low output/volume flow conditions through the main passage of the carburettor, therefore under low-load or slow-runing engine conditions implying a slight opening of the throttle 13, a considerable vacuum is produced in the diffuser 7 at the level of the outlet of passage 6, while a substantially zero vacuum is obtained at the level of the additional jet 9. This vacuum at the outlet of passage 6 is attended inter alia by a suction exerted in passage 10 and thus the additional jet 9 operates as a device for introducing additional air into the richness circuit, by absorbing an excess of air from the main air flow of the carburettor, which excess adds itself to that provided by the aeration jet 1, while reducing the richness of the air/fuel mixture delivered by the mixture jet 5 to the venturi 7.

As the output/volume flow increases in the main passage of the carburettor, i.e. throughout the range of intermediate engine speeds or part-load engine operating conditions, with the throttle 13 substantially half-open, the vacuum at the level of the additional jet 9 increases until it is balanced by the vacuum prevailing behind the jet 5. Therefore, the function of additonal aeration of the richness circuit through the additional jet 9 decreases in proportion thereto until it becomes zero. i.e. when the above-defined suctions balance each other, the additional jet 9 being then inoperative.

At very high output/volume values corresponding to heavy engine loads and full-throttle engine operation, the additional jet 9, by virtue of its position at the outer end of pipe section 14, lies substantially in the peripheral area of the vacuum column then prevailing centrally of the main air flow 12, while this column tends to be deflected externally of diffuser 7 for flowing directly through the venturi B, whereby a more pronounced vacuum is obtained at the level of the additional jet 9 in comparison with the vacuum produced behind the air/fuel mixture jet 5, so that the additional jet 9 will now operate as an enriching device by supplying air/fuel mixture complementary to the output of said mixture which is delivered by the main jet 5.

The carburettor mixture enriching device according to this invention is particularly simple and therefore reliable and economical, and capable of optimizing the adaptation of the richness as a function of the engine load while reducing to a substantial extent the release of polluting substances and the fuel consumption, notably during the transient phases and under part-load engine operating conditions.

What we claim is:

1. Enriching device for carburettors of internal combustion engines, comprising an aeration gaged orifice located at the upper portion of the float tank of the carburettor, a fuel gaged orifice communicating with the bottom of said fuel tank, and air/fuel mixture gaged orifice disposed in a passage interconnecting said aeration gaged orifice and said fuel gaged orifice and delivering said mixture at the level of the carburettor venturi, and an additional gaged orifice opening into the main passage of the carburettor, wherein said additional gaged orifice is located at the end of a pipe section projecting to a predetermined extent into the main passage upstream of said venturi and slightly upstream of the closed position of the starter shutter, whereby said additional gaged orifice, according to the negative pressure discrepancy existing between its position and that of the mixture gaged orifice, will regulate the richness of the air/fuel mixture by performing successively as an additional air inlet orifice for producing a leaner mixture passing through the mixture gaged orifice under low or moderate engine load conditions, this function decreasing gradually to zero, during the range of part-load operating conditions, and then as a gaged orifice supplying an additional output of air/fuel mixture, therefore as an enriching device, under high/load engine conditions.

2. Enriching device according to claim 1, in combination with a carburettor of the type comprising a pair of axial diffusers.

* * * * *